US008657133B2

(12) United States Patent
McGowan et al.

(10) Patent No.: US 8,657,133 B2
(45) Date of Patent: Feb. 25, 2014

(54) CUSTOMIZABLE MOUNTING SYSTEM FOR FURNITURE

(75) Inventors: Kevin McGowan, Saint Charles, MO (US); Steve Wahrhaftig, West Chester, PA (US); Cory Neudeck, Richburg, NY (US)

(73) Assignee: Ameriwood Industries, Inc., Wright City, MO (US)

( * ) Notice: Subject to any disclaimer, the term of this patent is extended or adjusted under 35 U.S.C. 154(b) by 42 days.

(21) Appl. No.: 13/323,565

(22) Filed: Dec. 12, 2011

(65) Prior Publication Data

US 2012/0145654 A1 Jun. 14, 2012

Related U.S. Application Data

(60) Provisional application No. 61/421,855, filed on Dec. 10, 2010.

(51) Int. Cl.
*A47B 47/03* (2006.01)

(52) U.S. Cl.
USPC ..... 211/189; 108/108; 312/7.2; 211/186

(58) Field of Classification Search
USPC ..... 211/87.01, 90.02, 103, 187, 183, 186, 211/188, 189, 190, 191, 193, 208; 108/108, 108/50.02; 52/36.6; D6/675.1, 678.1, D6/678.2; 248/125.1, 125.8, 243, 245; 312/7.2
See application file for complete search history.

(56) References Cited

U.S. PATENT DOCUMENTS

| | | | | |
|---|---|---|---|---|
| 3,965,826 | A | 6/1976 | Markham | |
| 4,116,509 | A * | 9/1978 | Smith | 312/107 |
| 5,313,891 | A | 5/1994 | Suttles | |
| 5,495,952 | A * | 3/1996 | Kainz | 211/90.04 |
| 6,044,986 | A * | 4/2000 | Wood | 211/87.01 |
| D480,237 | S * | 10/2003 | de Carolis | D6/474 |
| 6,732,660 | B2 * | 5/2004 | Dame et al. | 108/50.01 |
| D495,163 | S * | 8/2004 | Weatherly | D6/479 |
| D505,576 | S * | 5/2005 | Chang | D6/477 |
| D507,433 | S * | 7/2005 | Portnoy | D6/477 |
| D507,900 | S * | 8/2005 | Sexton | D6/474 |
| D508,171 | S * | 8/2005 | Choo | D6/477 |
| D508,801 | S * | 8/2005 | Holst | D6/477 |
| D539,565 | S * | 4/2007 | Sexton, III | D6/474 |
| D564,796 | S * | 3/2008 | Zambelli | D6/477 |
| D590,636 | S * | 4/2009 | Yang et al. | D6/477 |

(Continued)

FOREIGN PATENT DOCUMENTS

JP 2009118224 A * 5/2009

OTHER PUBLICATIONS

International Search Report, International Patent Application No. PCT/US2011/064479, mailed Aug. 9, 2012, 9 pages.

*Primary Examiner* — Joshua Rodden
(74) *Attorney, Agent, or Firm* — Lewis, Rice & Fingersh, L.C.

(57) ABSTRACT

This disclosure relates to pieces of furniture for housing electronic devices and that give the appearance of being permanently built into a wall. The pieces of furniture comprise panels which can easily be removed and which house and hide wires of electronic devices, giving the appearance that the wires are housed beyond the wall. Additionally, the pieces of furniture are designed to have electronic devices mounted thereon with little mounting (i.e., studs are unnecessary) or no mounting to secure the piece of furniture onto the wall.

15 Claims, 8 Drawing Sheets

(56) References Cited

U.S. PATENT DOCUMENTS

| | | | | |
|---|---|---|---|---|
| D591,089 | S * | 4/2009 | Sexton | D6/479 |
| D593,776 | S * | 6/2009 | Sexton | D6/478 |
| D595,978 | S * | 7/2009 | Portnoy et al. | D6/477 |
| D607,671 | S * | 1/2010 | Sexton | D6/479 |
| 7,676,992 | B2 * | 3/2010 | Burns | 52/36.6 |
| 8,087,735 | B1 * | 1/2012 | Rheault et al. | 312/109 |
| 8,191,485 | B1 * | 6/2012 | Whalen et al. | 108/42 |
| D663,139 | S * | 7/2012 | Zambelli | D6/470 |
| 8,276,862 | B2 * | 10/2012 | Eshita et al. | 248/274.1 |
| 8,353,490 | B2 * | 1/2013 | Spinelli | 248/201 |
| 2002/0043187 | A1 | 4/2002 | Felton et al. | |
| 2006/0096939 | A1 * | 5/2006 | Liu | 211/189 |
| 2006/0230993 | A1 * | 10/2006 | Becker et al. | 108/180 |
| 2010/0193455 | A1 | 8/2010 | Russell et al. | |
| 2011/0163050 | A1 * | 7/2011 | Grove | 211/26 |

* cited by examiner

CUSTOMIZABLE MOUNTING SYSTEM FOR FURNITURE

CROSS REFERENCE TO RELATED APPLICATION(S)

This application claims the benefit of U.S. Provisional Patent Application Ser. No. 61/421,855, filed Dec. 10, 2010, the entire disclosure of which is incorporated by reference herein.

BACKGROUND OF THE INVENTION

1. Field of the Invention

This disclosure relates to pieces of, and customizable mounting systems for, furniture, including freestanding furniture for housing televisions, stereos, computers, and other related electronic equipment, as well as for storage, bookcases, fireplaces, and benches.

2. Description of Related Art

Historically, mounting systems for furniture and associated shelving have required the systems to be secured to the studs in the wall to prevent tipping or pulling away of the furniture from the wall and to adequately secure the furniture. This often limited the placement of mounted furniture to particular spaces in a room or office where such studs were placed. Further, it often required drilling or bolting of the furniture to the wall or floor in such a manner that visually marred the floor or wall surface and limited any subsequent movement of the furniture. Alternatively, prior mounting systems for furniture prevented tipping of the furniture by utilizing a footprint substantially larger than that of the furniture being mounted and that often interfered with wall molding and would not allow the system to be flush with the wall.

Accordingly, there is a need for mounting systems for furniture that do not have the above limitations but rather permit furniture to be mounted in multiple places in a room or office, without reference to the placement of wall studs, such that the furniture can be readily moved within the room or office subsequent to installation and without marring the surfaces of the walls or floor. There is also a need for a mounting system for furniture that does not require a footprint larger than the furniture itself and that permits the system to be flush with the wall and not interfere with the wall molding, for example.

Further, prior mounting systems for furniture and associated shelving were limited to pre-selected designs and placement of the furniture pieces on such systems. This severely limited the design choices of the owner or use of such furniture.

Accordingly, there is a need for customizable mounting systems for furniture that do not limit the owner or user of the furniture to only one pre-selected arrangement of furniture pieces and accessories.

It is also known that electronic equipment is generally located and stored on some type of shelving system, console, stand or desk for convenient operation and use. For example, a home entertainment center (or stereo console) is a piece of furniture seen in many homes, which houses major electronic items, such as a television set, a VCR and/or DVD player, stereo components (such as an AM/FM tuner, multi-disc compact disc changer, record player, one or more cassette players and graphic equalizer), and cable or satellite television receivers. Furthermore, desks are often used in homes and offices to store computers, printers, phones and other associated electronic equipment. These electronics typically require some type of cords, cables and/or wires (which are generally referred to herein as wires) either interconnected with the electronics or connected to an electrical outlet. Typically, though, the electronics are spatially separated such that these wires are easily viewable and visually unappealing. In the alternative, large entertainment centers and desks were used to house all the electronics and hide the wires. Such entertainment centers and desks, however, were often very bulky and greatly contrasted with the appearance of the wall.

The invention of the flat panel televisions and computer monitors has substantially reduced the need for these large pieces of furniture. Furthermore, these flat panel televisions are very thin in comparison to the older, conventional CRT televisions, making them suitable for wall-mounting. As a result, smaller pieces of furniture can be utilized to house the remaining electronics.

Wall-mounting of televisions, however, has problems of its own. While flat panel televisions are much smaller than conventional CRT televisions, they are still very heavy. Thus, the flat panel televisions are typically mounted with large screws and mounted into studs on the wall. Furthermore, because the flat panel televisions is mounted to the wall, it is separated from the remaining interconnected electronics (e.g., cable box, DVR player, surround system, etc.) and lacking an efficient wire management system. Thus, visually unappealing exposed wires run along the wall from the flat panel televisions to these electronics.

Moreover, a wall is a permanent structure and provides no access points to hide the wires and run the wires within the wall. Therefore, to alternatively run wires within the wall (and thus hide the wires), the dry wall had to be removed, a wire management system installed (e.g., a conduit for running wires from the television down to the remaining interconnected electronics with openings at different points where electronic devices are located), and a new dry wall permanently installed over the wire management system. And since the dry wall is permanent, it can be very difficult to add or remove wires, requiring fishing the wire in or out of the different openings within the conduit. Thus, although the wires may run behind the wall to hide the visually unappealing exposed wires, this is a very costly, time-consuming, and difficult process, requiring significant structural and aesthetic changes to the wall in order to hide the wires and to access them again after they have been concealed.

Accordingly, there is a need for sleeker and slimmer furniture for housing modern electronics with an efficient design and system for managing wires.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of above described and other problems in the art, described herein, among other things are various types of mounting systems for furniture that use the wall and floor to house electronic devices without the requirement of securing or mounting the frame to wall studs, that are readily customizable, and that house differing types of electronics or other household items and wires in an efficient and visually appealing manner. In an embodiment, the piece of furniture for housing electronic devices and configured to be placed against a wall, the piece of furniture comprises: at least two uprights having top ends, bottom ends, frontsides, and backsides, the backsides being sized and shaped to be placed against a wall and the backsides of the uprights defining a plane; at least one cross-beam interconnecting the uprights; at least one shelf for holding electronic devices, the shelf being removably connected to the cross-beam and extending beyond the frontsides of the uprights; a loadbearing base connected to the bottom ends of the uprights; and a panel for concealing wires of electronic devices, the panel being removably connected to the uprights in such a way that an internal space is created between the panel and the plane defined by the backsides of the uprights.

In some embodiments, the piece of furniture further comprises plates connected between the uprights for mounting a television to the piece of furniture. In other embodiments, the loadbearing base extends beyond the frontsides of the uprights.

In one embodiment, the backsides of the uprights are sized and shaped to be placed flush against a wall such that the piece of the furniture appears to be part of and integral with the wall. The base may be offset from the plane defined by the backsides of the uprights, the base being sized and shaped to be substantially flush against molding on the wall.

In another embodiment, the base includes a removable covering for enclosing an interior space within the base. The base may also comprise a fireplace in an embodiment. In still other embodiments, an internal space is created between the panel and the wall when the piece of furniture is placed against the wall.

Also disclosed herein is a system for housing electronic devices, the system comprising: a wall; and a piece of furniture for housing electronic devices and configured to be mounted against the wall. In this embodiment, the piece of furniture comprises: at least two uprights having top ends, bottom ends, frontsides, and backsides, the backsides being sized and shaped to be placed against a wall and the backsides of the uprights defining a plane; at least one cross-beam interconnecting the uprights; at least one shelf for holding electronic devices, the shelf being removably connected to the cross-beam and extending beyond the frontsides of the uprights; a loadbearing base connected to the bottom ends of the uprights; and a panel for concealing wires of electronic devices, the panel being removably connected to the uprights in such a way that an internal space is created between the panel and the wall.

In one embodiment, the piece of furniture is mounted to the wall. In other embodiments, the piece of furniture further comprises plates connected between the uprights for mounting a television to the piece of furniture. In another embodiment, the backsides of the uprights are placed flush against a wall such that the piece of the furniture appears to be part of and integral with the wall. The base also may be offset from the wall and sized and shaped to be substantially flush against molding on the wall. In yet another embodiment, an internal space is created between the panel and the wall.

Also disclosed herein is a piece of furniture for housing electronic devices and configured to be mounted against a wall, the piece of furniture comprising: at least two uprights having top ends, bottom ends, frontsides, and backsides, the backsides being sized and shaped to be mounted against a wall and the backsides of the uprights defining a plane; at least one cross-beam interconnecting the uprights; at least one shelf for holding electronic devices, the shelf being removably connected to the cross-beam and extending beyond the frontsides of the uprights; and a loadbearing base connected to the bottom ends of the uprights. The uprights of this piece of furniture are hollow and include a plurality of holes for housing wires of electronic devices.

In one embodiment, the piece of furniture further comprises plates connected between the uprights for mounting a television to the piece of furniture. In another embodiment, the backsides of the uprights are sized and shaped to be flush mounted against a wall such that the piece of the furniture appears to be part of and integral with the wall. The base also may be offset from the wall and sized and shaped to be substantially flush against molding on the wall. The piece of furniture also may be mounted to the wall by bolting the backsides of the uprights to the wall.

DESCRIPTION OF PREFERRED EMBODIMENT(S)

Figure 1A:
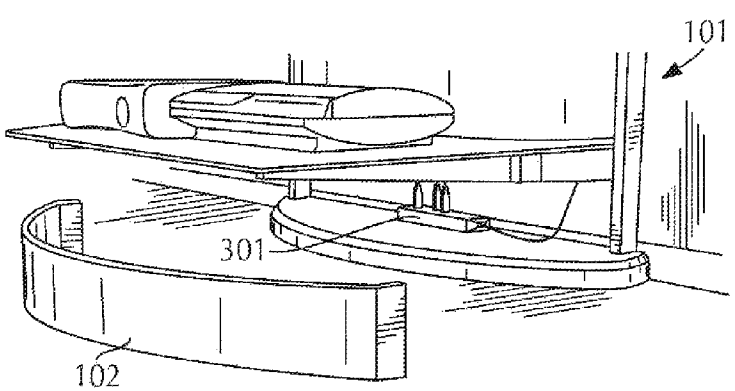
FIG. 1A provides a perspective view of the embodiment of FIG. 1 depicting the details of the loadbearing base.
Figure 1B:
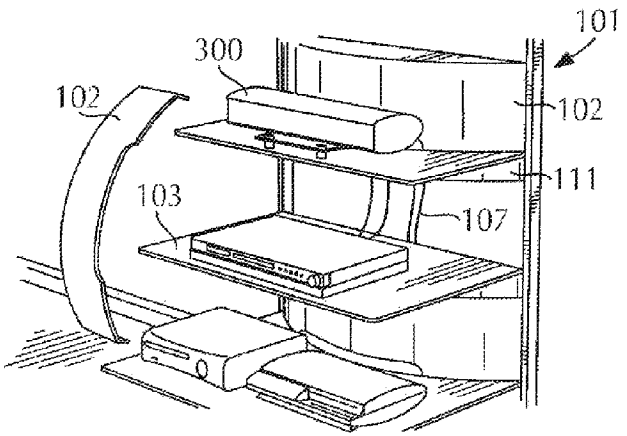
FIG. 1B provides a perspective view of the embodiment of FIG. 1 depicting the details of the removable panel and wire management system.

The electronic storage units and pieces of furniture of the present disclosure have numerous advantages over currently known units and systems for storing electronics. First, the known pieces of furniture were often large and bulky, contrasting greatly with the wall against which the units were placed. This unnecessarily increases the costs of manufacture, while also decreasing the visual appearance. The pieces of furniture of the present disclosure are generally sleek, slim and visually appealing, appearing as though the unit were part of the wall which simultaneously being freestanding (i.e., placed against a wall) with little or no mounting to a wall (i.e., mounting to a stud is unnecessary).

Second, the known electronic storage units require that the television be mounted and secured directly to the wall. Thus, the mounting requires installation into studs in the wall in order to support the weight of the television, creating unsightly holes in the wall. The pieces of furniture of the present disclosure, by having an integrated television mount and a weight-bearing base, give the appearance of a television secured to the wall but generally do not require mounting to studs, and at most, require minimally mounting onto the wall in order to prevent the unit from tipping forward (i.e., as opposed to mounting to support the weight of the electronics device(s)).

Third, because the television is typically mounted a significant distance above the other interconnected electronics, the wires between the electronics are either exposed or hidden behind the wall. The exposed wires are visually unappealing; however, it is very costly and requires significant structural changes to the wall in order to hide the wires behind the wall. The pieces of furniture of the present disclosure, with their removable panels or other disclosed wire management systems, efficiently hide and manage the wires, while maintaining the appearance of a television mounted to the wall. In other words, the units essentially recreate a wall (and thus appear built into the existing wall) in a format that allows cables, cords, and wires to be hidden from the exposed, exterior surface of the unit. In this regard, the panels of the units are offset from the wall, and thus create a hollow space between the panel and the wall, which hides the wires from view while still allowing for easily access to the wires. Furthermore, both the panels and the shelves of the present disclosure can be added and removed with ease and without the need for tools.

The present disclosure is directed to various types of mounting systems for furniture that use the wall and floor to house electronic devices without the requirement of securing or mounting the frame to wall studs, that are readily customizable, and that house differing types of electronics or other household items and wires in an efficient and visually appealing manner. With reference to FIGS. 1-8, customizable mounting systems for furniture will be described according to several embodiments of the present invention.

Turning now to FIGS. 1 through 8, a unit or piece of furniture (100), in accordance with various embodiments of the invention, are shown. The pieces of furniture (100) pictured in FIGS. 1-6 are generally comprised of five main elements: a frame (101), removable panels (102), shelves (103), a base (104), and mount brackets (105). However, not all the elements are necessary. For example, the embodiments of the system (100) in FIGS. 7-8 do not have the mount brackets (105). In these embodiments a computer monitor (220) may be placed on a shelf (103). Additionally, a television could also be placed on a shelf (103) for use of the system (100) as a television stand. Additionally, the embodiments of the piece of furniture (100) in FIGS. 7 and 8 do not have the removable panels (102). Instead, as discussed more fully below, the uprights (110) are used to efficiently manage the wires.

The structure of the frame (101) varies slightly in the disclosed embodiments. For example, in the embodiments in FIG. 1-6, the frame (101) is comprised of two substantially vertical uprights (110) connected together with a beam (111), back plates (130) and a base (104). The backsides of the uprights (110) are generally sized and shaped to be placed against a wall. In some embodiments, this enables the piece of furniture (100) to be placed flush against a wall. In other embodiments, it may be desirable or necessary to mount the backsides of the uprights (110) to the wall in order to help house the electronic devices and to ensure the piece of furniture (100) does not topple. These embodiments are sized and shaped accordingly. Generally, however, the piece of furniture (100) is designed to sufficiently withstand the weight of the electronic devices such that the piece of furniture (100) does not need to be mounted to studs in the wall (201). In other words, piece of furniture (100) itself is weight-bearing, removing the need to have the wall bear the weight of the television. If mounting of the piece of furniture (100) is desired, this is merely to prevent the unit (100) from tipping (and not to support the weight of the television or other electronic devices.

The back plates (130) are substantially horizontal and substantially perpendicular to the uprights (110) and connected near the top ends (112) of the uprights (110). The television (200) is connected to the mount brackets (105), which can then be removably attached to the back plates (130), as suggested by FIGS. 1-6. As one of ordinary skill in the art would readily appreciate, the precise configuration for mounting a television described herein (i.e., the back plates (130) and mount brackets (105)) are by no means the only type of television mount that could be incorporated into the piece of furniture of the present disclosure. Other television mounts, as that term is readily understood, would be appropriate for use in the piece of furniture of the present disclosure. Generally, when a television or other electronic device is mounted to the piece of furniture (100), it is desirable to mount the piece of furniture (100) to the wall (201).

Additionally, the base (104), connected near the bottom ends of the uprights (110), is load-bearing and adds extra stability to the piece of furniture (100). In other words, this base (104) provides sufficient support such that the piece of furniture (100) will not topple forward when the television (200) is attached and when the piece of furniture (100) is placed against a wall (201). As a result of this configuration, advantageously, the television (200) does not need to be mounted directly to the wall (201). While the piece of furniture (100) may be mounted to the wall (201), this connection merely provides additional support if so desired and it is not necessary to bolt the piece of furniture (100) to studs in the wall (201).

Figure 1:
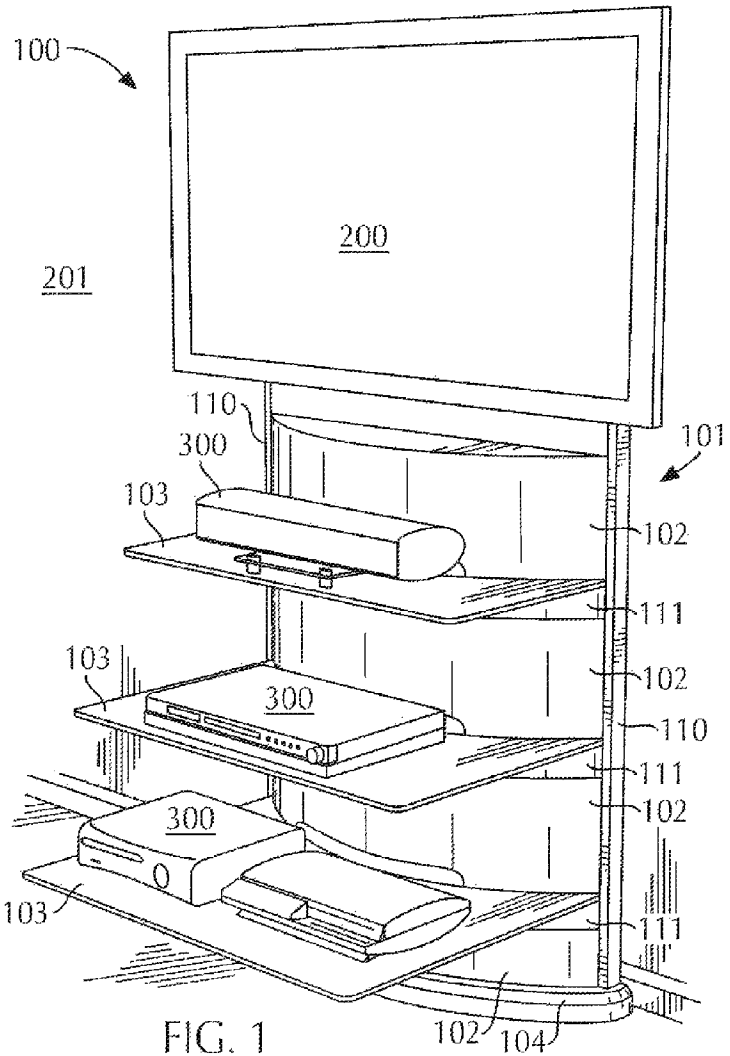
FIG. 1 provides a perspective view of an embodiment of the piece of furniture.
Figure 4:
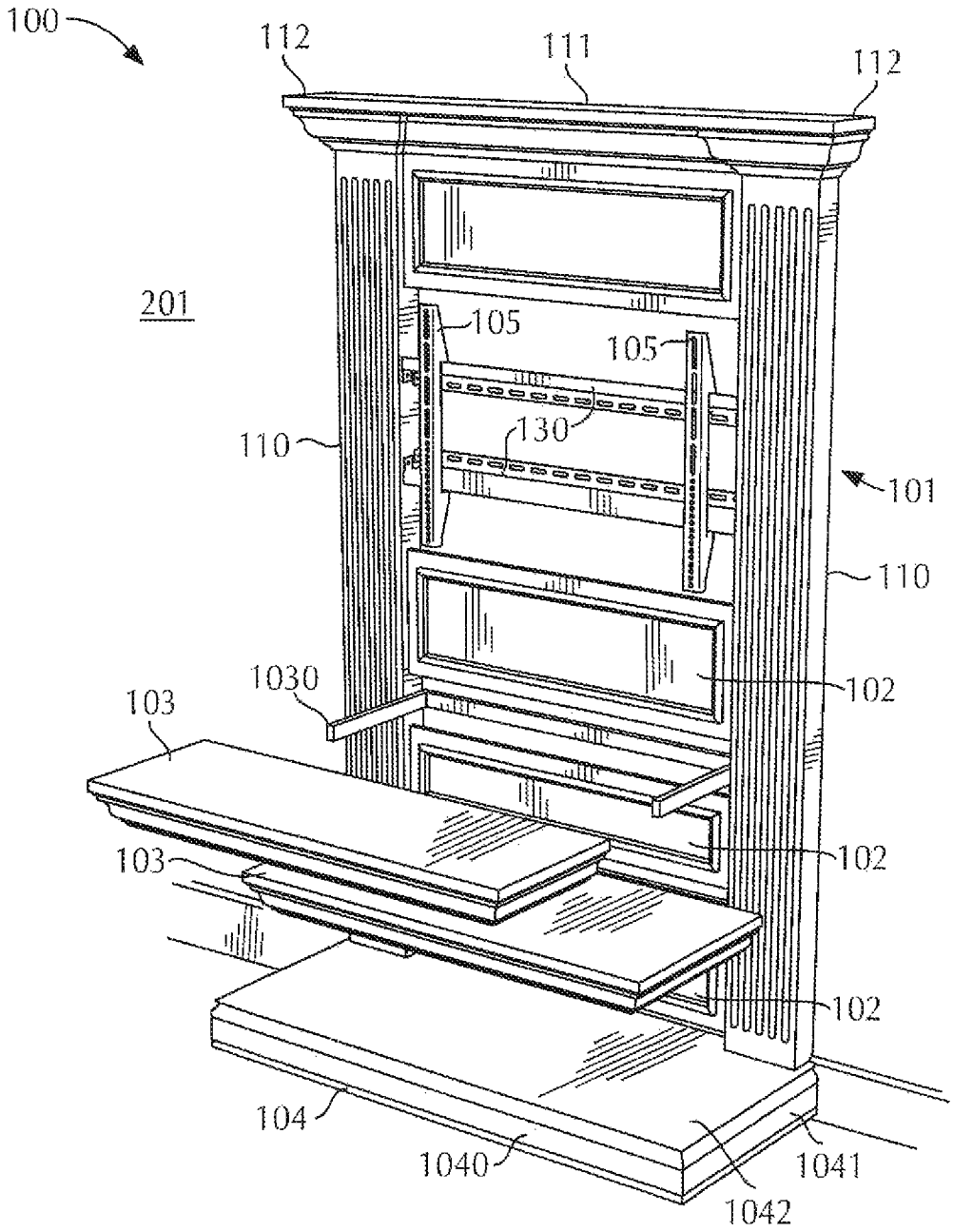
FIG. 4 provides a perspective view of the embodiment of FIG. 3 depicting the details of the various parts of this embodiment.
Figure 5:
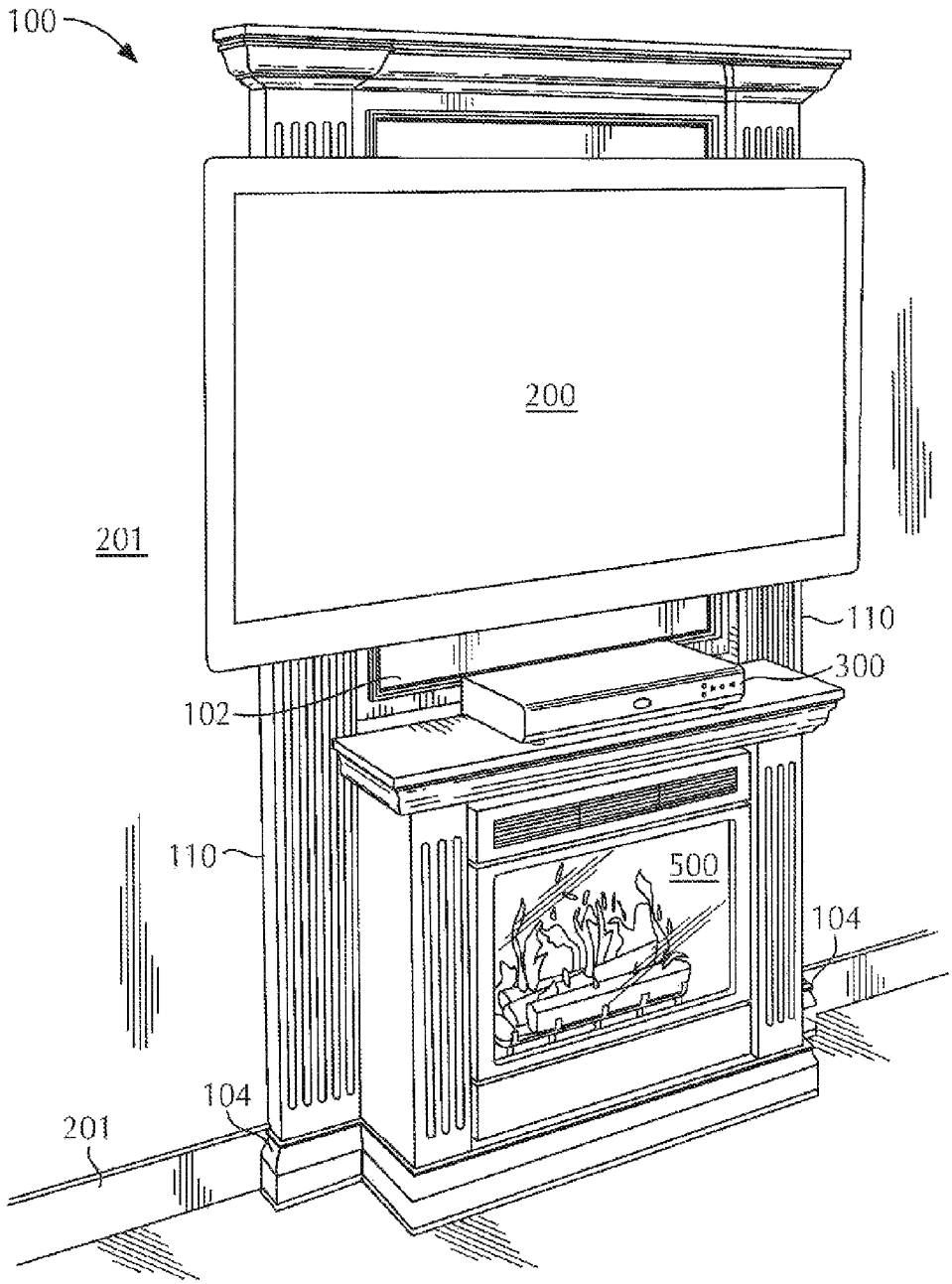
FIG. 5 provides a perspective view of an alternative embodiment of the piece of furniture.

As noted above, the base (104) of the frame (101) preferably has a depth sufficient to withstand the force of the television (200) such that mounting the piece of furniture (100) to the wall (201) is unnecessary. While the depth of this base is by no means necessary (as shown, for example, in FIGS. 6-8), the depth of the base (104) also provides other advantages; specifically, the base (104) is deep enough to house other electronic wire management devices, such as a power strip (301), as shown in FIG. 1. In this embodiment, the electronic wire management device is hidden by placing a panel (102) in front of the base, which acts as a covering, enclosing an interior space within the base (104). In an alternative embodiment, a portion of the base (104), such as the front (1040), top (1042), or sides (1041), may be removable in order to hide or cover these devices, as suggested in FIGS. 3-5. While a power strip (301) is disclosed in this embodiment, it is by no means the only such wire management device and any other similar device could also be stored in the base (104); for example, although not depicted, an internet router could be stored in the base (104). In yet another embodiment, the base (104) may comprise an electronic fireplace (500), as shown in FIG. 5.

Figure 6A:
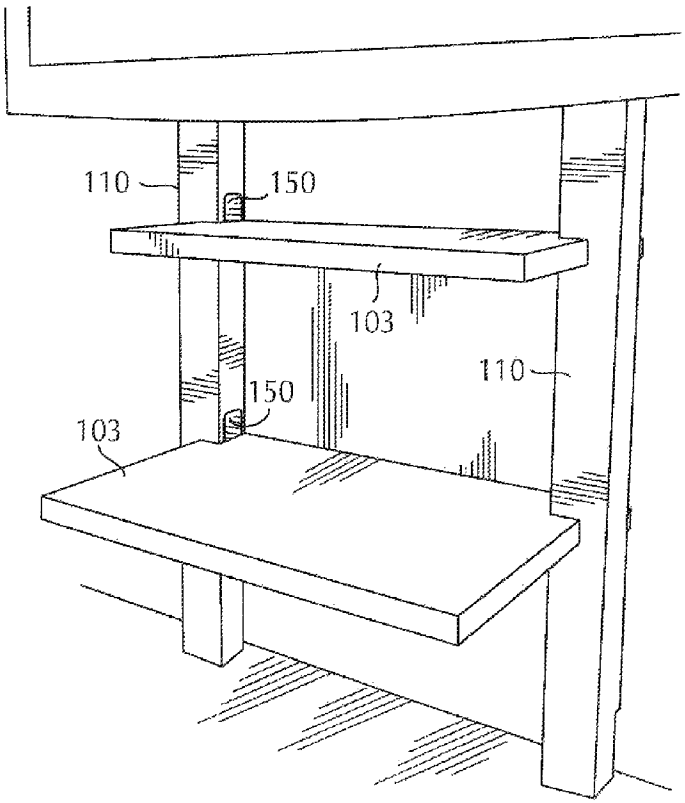
FIG. 6A provides a perspective view of the embodiment of FIG. 6 depicting the details of the wire management system.
Figure 6:
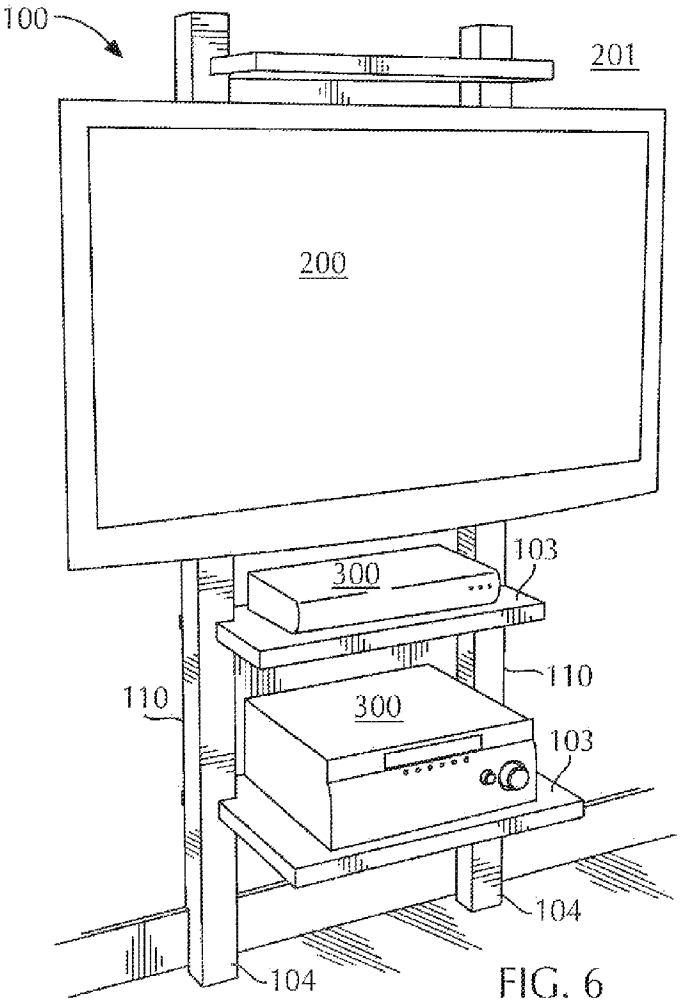
FIG. 6 provides a perspective view of an alternative embodiment of the piece of furniture.
Figure 7A:
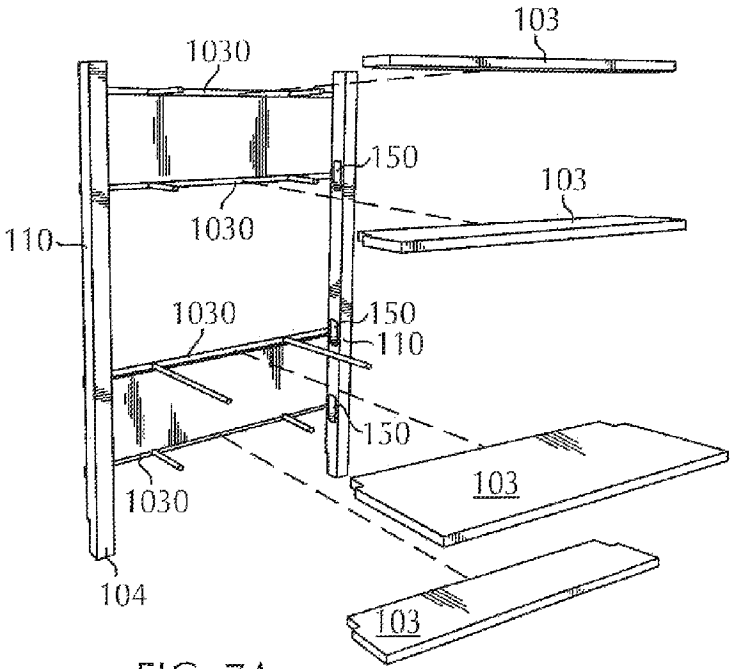
FIG. 7A provides a perspective view of the embodiment of FIG. 7 depicting the details of the various parts of this embodiment.
Figure 7:
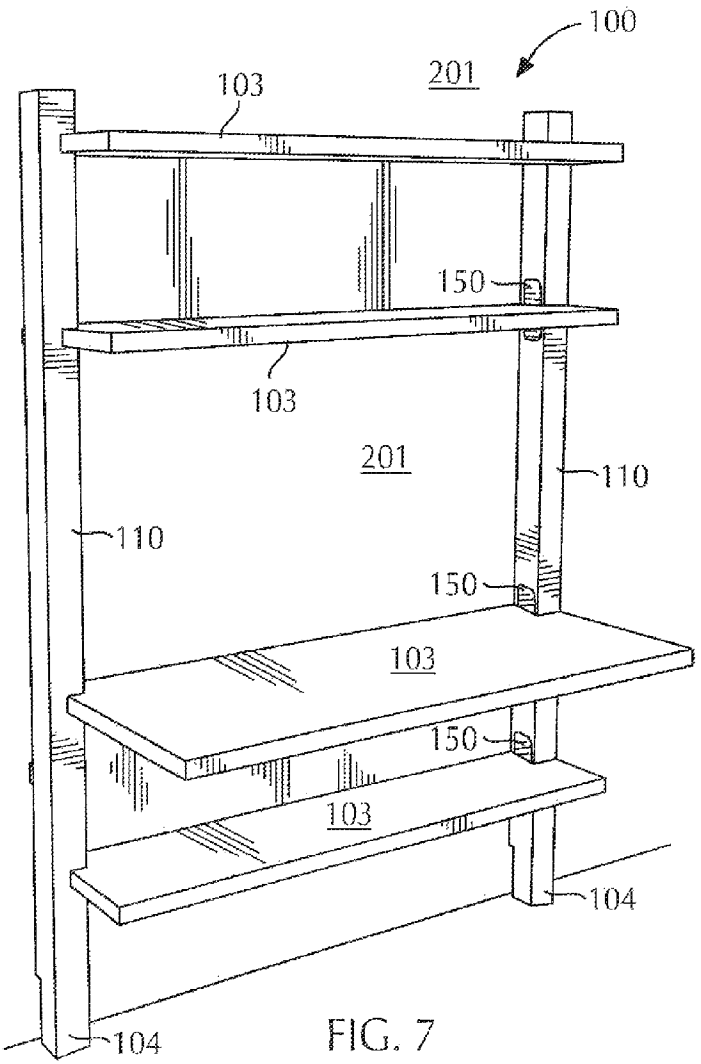
FIG. 7 provides a perspective view of an alternative embodiment of the piece of furniture.
Figure 8:
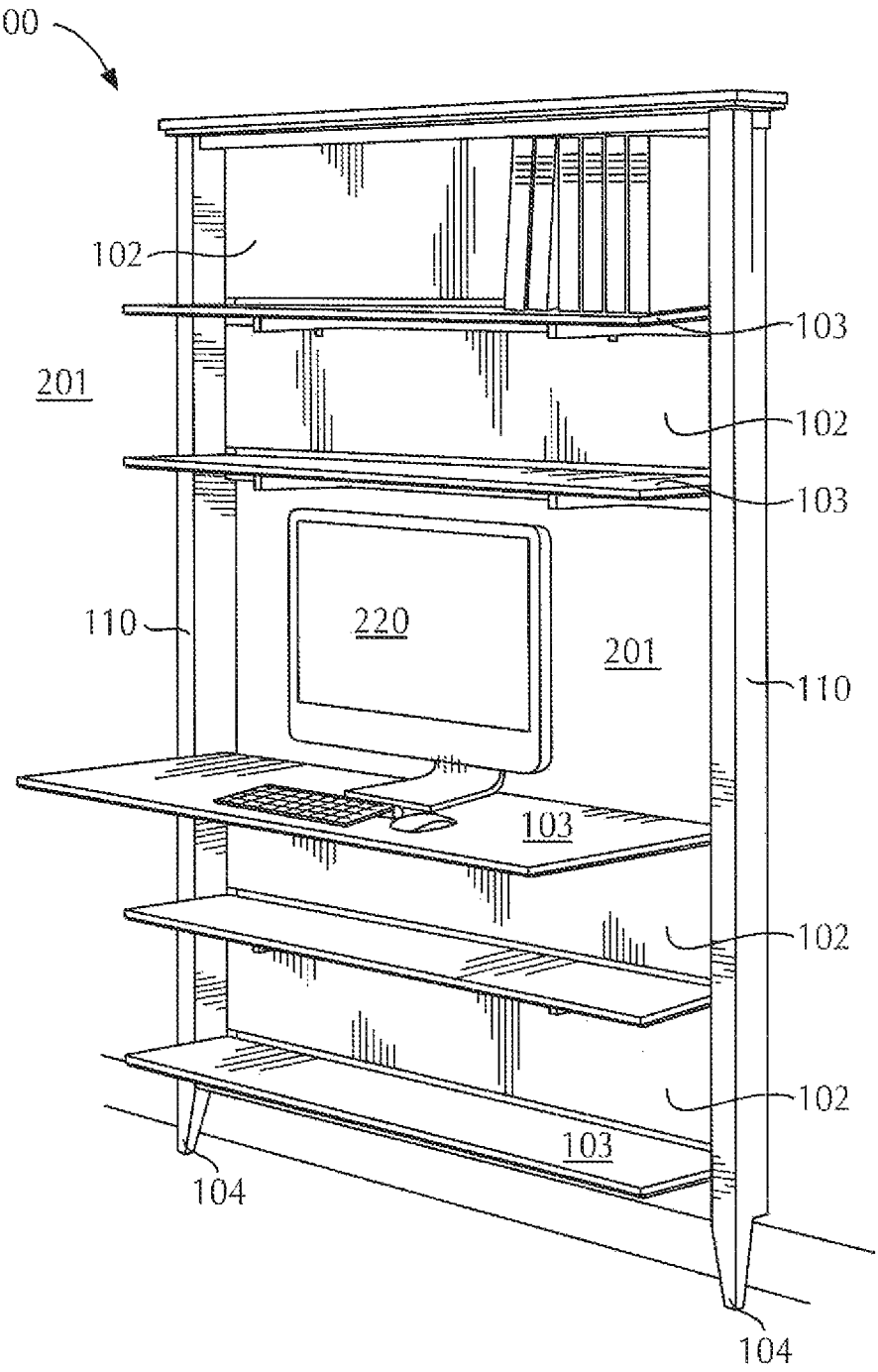
FIG. 8 provides a perspective view of an alternative embodiment of the piece of furniture.

In an alternative embodiment, the base (104) may have a much shorter depth, as shown in FIGS. 6-8. In such embodiments, it may be necessary to secure the piece of furniture (100) to the wall, preferably into studs in the wall (201), to prevent the piece of furniture (100) from toppling when a television (200), a computer monitor (220), or the like is stored thereon.

In a preferred embodiment, the base (104) is also offset from the wall (201) at a sufficient distance such that the backsides of the uprights (110) are substantially flush against the wall (201) while the base (104) is substantially flush against any molding on the wall (201). Such a configuration is shown and suggested in FIGS. 3-8. This configuration advantageously gives the appearance that the piece of furniture (100) is part of and integral with the wall (201) even in the event the piece of furniture is not attached to the wall but is freestanding.

Figure 2:
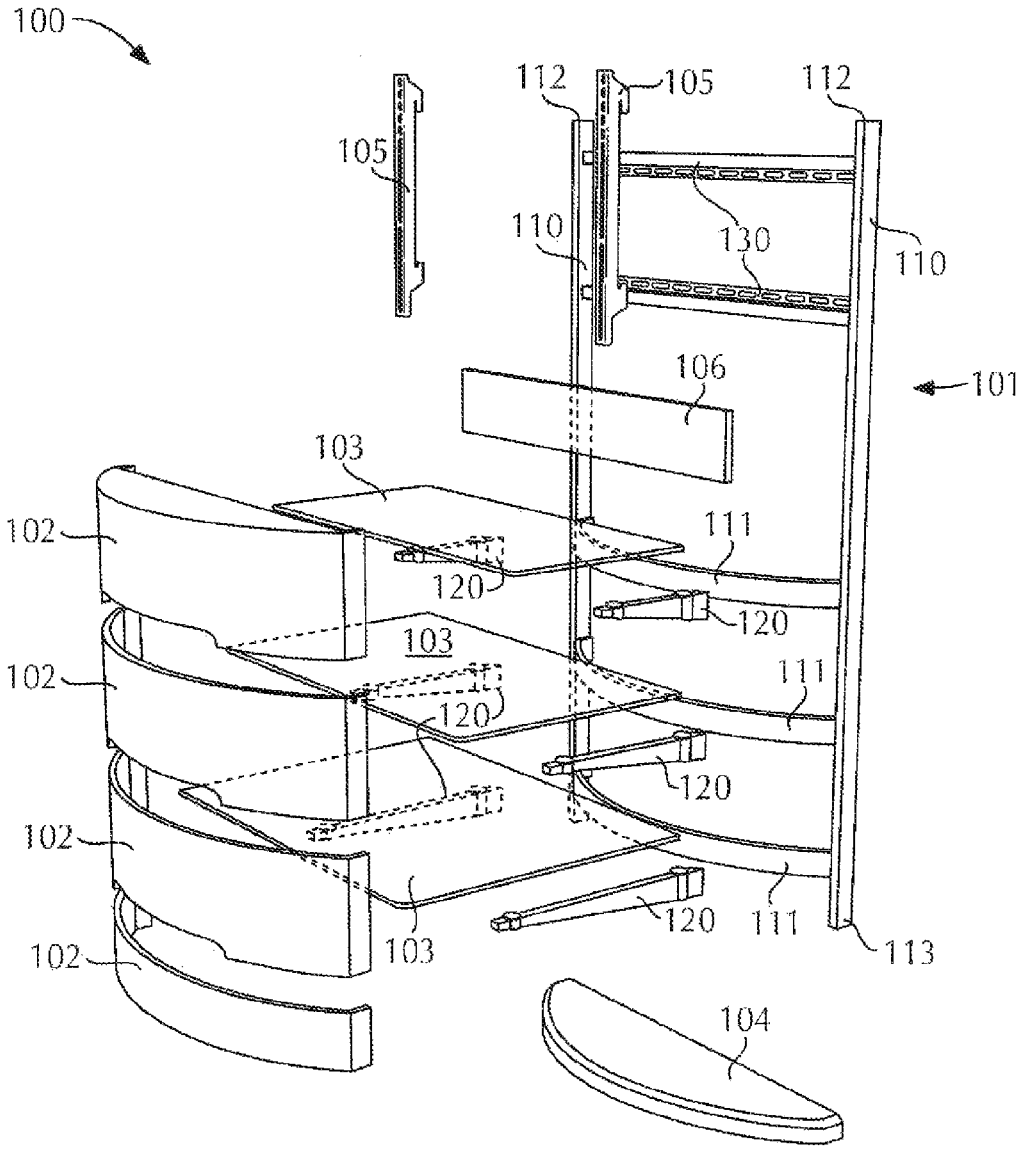
FIG. 2 provides a perspective view of the embodiment of FIG. 1 depicting the details of the various parts of this embodiment.
Figure 3A:
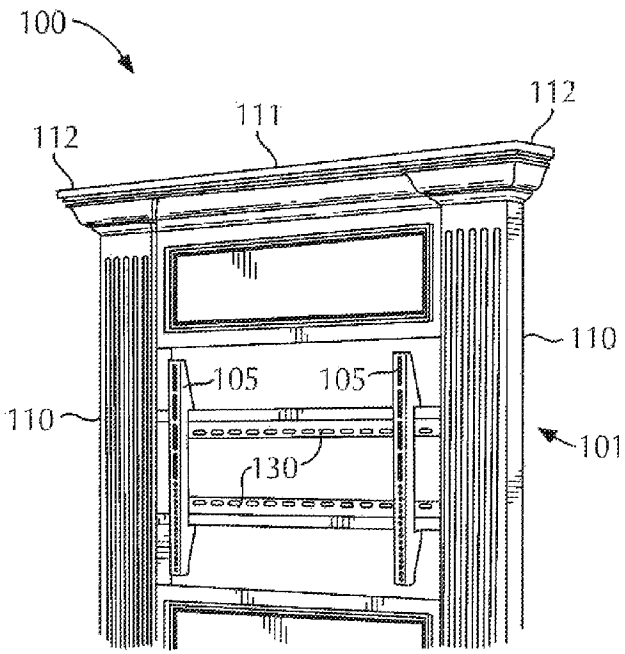
FIG. 3A provides a perspective view of the embodiment of FIG. 3 depicting the details of the television mount.
Figure 3:
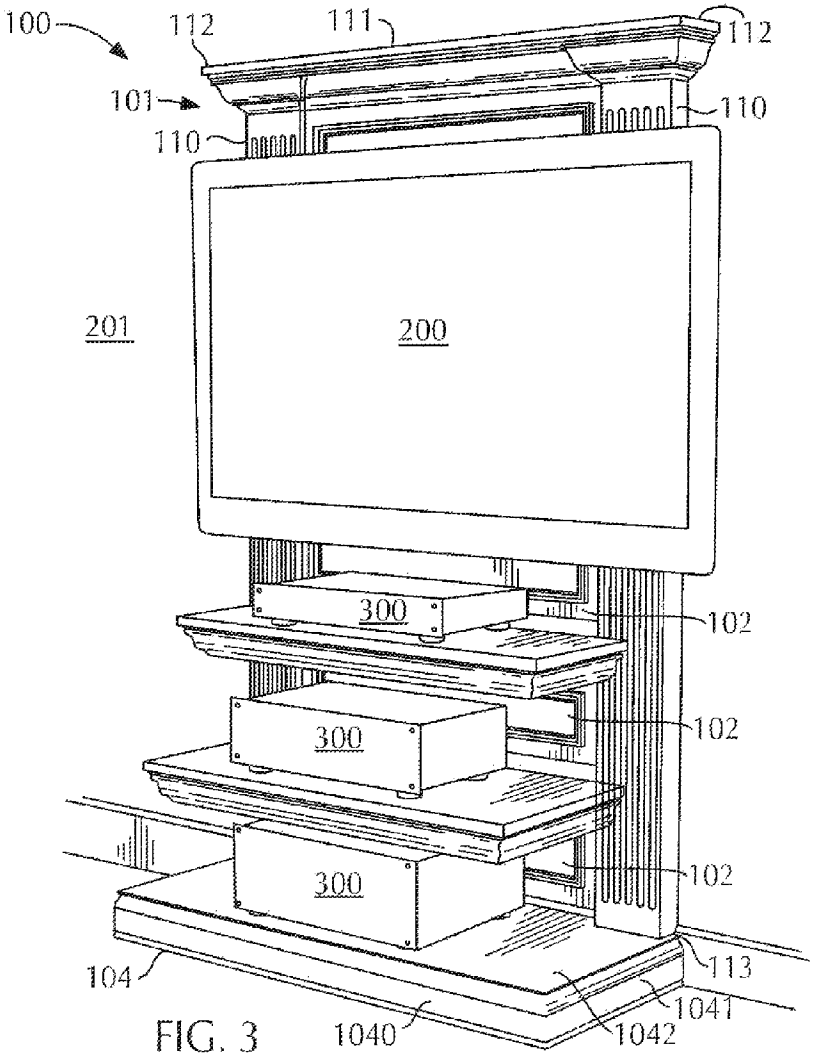
FIG. 3 provides a perspective view of an alternative embodiment of the piece of furniture.

Additionally, in the embodiments in FIGS. 1-2, the frame (101) is comprised of any known suitable metal and has multiple metal beams (111) that are substantially horizontal and substantially perpendicular to the metal uprights (110) and connected towards the bottom ends (113) of the uprights (110). Alternatively, the frame (101) and uprights (110) may be wood, as shown in FIGS. 3-5.

In the embodiments in FIGS. 1-2, at least one cantilever (120) is removably connected to at least one of the beams (111). These cantilevers (120) serve to support the shelves (103), which are removably placed thereon and without the need for tools. Generally, various types of electronics (300) are placed on the shelves (103). However, the shelves (103) can store any article that one would typically store on a console, such as vases, picture frames, lamps, books, and the like. While cantilevers (120) are shown in the depicted embodiment in FIGS. 1 and 2, any sort of support could be used for the shelves (103), as one of ordinary skill in the art would readily recognize. For example, in the embodiments in FIGS. 3-5, a single metal support (1030) is used to support the shelves (103), as shown in FIG. 5 and suggested in FIGS. 3-4. In these embodiments, the metal support (1030) is a single metal cross-beam connected to the uprights (110). The shelves (103) can then be placed on top of the metal support (1030), or alternatively, the shelves (103) may have holes in them, such that the shelves (103) may slide into the metal support (1030), as shown in FIG. 7.

Preferably, the piece of furniture (100) of the embodiments in FIGS. 1-5 and 8 have removable panels (102). These panels (102) are connected to the frame (101) behind the shelves (103) and between the beams (111) and uprights (110), resulting in an internal space between the panels (102) and a plane defined by the backsides of the uprights (110). This configuration advantageously results in an internal, hollow space between the panels (102) and the wall (201) which can be used to house and hide electronic wires (107). The panels (102) are preferably removably connected is such a manner that the panels (102) can be connected and removed without the need for tools, for example, by way of a spring ball connection, a hanger connection, or the like. Additionally, these panels (102) preferably have some type of opening, such as a curved bottom on the panel (102), when connected to the frame (101). Alternatively, the panels (102) may be flat and inserted slightly above the corresponding shelf (103), creating an opening there between, such that the wires (107) can be placed and inserted in this opening, as shown in FIGS. 3-5 and 8. As a result, in either situation, when electronics (300) are placed on the shelves (103), the wires (107) connecting the electronics and plugging into the outlet are advantageously hidden behind the panels (102), as shown and suggested in FIGS. 1-5 and 8. Furthermore, the wires (107) are hidden behind the panels (102), giving the appearance that the wires (107) are behind the wall (201) but advantageously without the need to change or alter the structure of the wall (201). Even if the panels (102) are not used to hide wires, the panels (102) are often used to hide at least a portion of the frame (101).

As noted herein and throughout, the design of the piece of furniture (100) advantageously provides the appearance that the piece of furniture (100) does not comprise a modular furniture unit at all, but instead comprises a furniture unit which has been permanently built into or part of the wall (201). In other words, the piece of furniture (100) essentially recreates a wall in a format that allows for wires and cords to be hidden within the recreated wall (i.e., the piece of furniture), which gives the appearance that the cords or wires are hidden within the actual wall (201).

As an alternative means of wire management, the uprights (110) of the frame (101) may be hollow and a sufficient thickness to house the wires in the uprights (110), with the wires being inserted into holes (150) in the uprights (110). Such a configuration is disclosed and suggested in FIGS. 6-7.

Although not described in detail, numerous other embodiments are possible in accordance with the present invention. Several different of these embodiments are shown and depicted herein.

Taken together, the piece/unit of furniture creates new opportunities for advantageously storing electronic equipment and for mounting furniture in a versatile and customizable manner. This design is slim and sleek and gives the appearance not only that the piece of furniture is built into and part of the wall but also that the television is mounted to the wall, and without changing the structure of the wall. Furthermore, mounting to the wall is not required to support the weight of the electronic devices stored thereon. In other words, a television can advantageously be securely mounted to the unit without the need of mounting the television or piece of furniture directly into the wall. In other words, heavy-duty mounting (e.g., weight-bearing mounts to studs) is unnecessary, and preventing the unit from tipping forward would be the only reason, if at all, to mount the piece of furniture to the wall (and this mounting is minimal at that). Moreover, wires are able to be efficiently managed and hidden with this design and piece of furniture. This is largely accomplished with the unit's removable panels which are offset from the wall, and thus create a hollow space between the panel and the wall, which hides the wires from view while still allowing for easily access to the wires and maintaining the appearance of a television mounted to the wall. In other words, the units essentially recreate a wall (and thus appear built into the existing wall) in a format that allows cables, cords, and wires to be hidden from the exposed, exterior surface of the unit. Lastly, both the panels and the shelves of the unit can be added and removed with ease and without the need for tools, allowing even greater access to the wires and electronic devices.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A piece of furniture for housing electronic devices and configured to be placed against a wall, the piece of furniture comprising:

at least two uprights having top ends, bottom ends, frontsides, and backsides, the backsides being sized and shaped to be placed against a wall and the backsides of the uprights defining a plane;

a cross-beam interconnecting the uprights;

a shelf for holding electronic devices, the shelf being removably connected to the cross-beam and extending beyond the frontsides of the uprights;

a loadbearing base connected to the bottom ends of the uprights, the loadbearing base having a top generally perpendicular to the uprights; and a panel for concealing wires of electronic devices, the panel being removably connected to the uprights between the loadbearing base and the cross-beam in such a way that an internal space is created between the panel and the plane defined by the backsides of the uprights and the internal space includes substantially all of the top of the loadbearing base said panel being curved and extending beyond the frontsides of the uprights, and said cross-beam being curved and extending beyond the frontsides of the uprights such that a frontmost surface of the panel is substantially flush with an outermost surface of the cross-beam.

2. The piece of furniture of claim 1 further comprising plates connected between the uprights for mounting a television to the piece of furniture.

3. The piece of furniture of claim 1, wherein the loadbearing base extends beyond the frontsides of the uprights.

4. The piece of furniture of claim 1, wherein when the backsides of the uprights are placed flush against the wall the piece of furniture appears to be part of and integral with the wall.

5. The piece of furniture of claim 1, wherein the internal space is created between the panel and the wall when the piece of furniture is placed against the wall.

6. A system for housing electronic devices, the system comprising:

a wall; and a piece of furniture for housing electronic devices and configured to be mounted against the wall, the piece of furniture comprising:

at least two uprights having top ends, bottom ends, frontsides, and backsides, the backsides being sized and shaped to be placed against the wall and the backsides of the uprights defining a plane;

a cross-beam interconnecting the uprights;

a shelf for holding electronic devices, the shelf being removably connected to the cross-beam and extending beyond the frontsides of the uprights;

a loadbearing base connected to the bottom ends of the uprights, and having a top generally perpendicular to the uprights; and a panel for concealing wires of electronic devices, the panel being removably connected to the uprights between the shelf and the loadbearing base in such a way that an internal space is created between the panel and the wall, and the internal space encloses substantially all the top of the loadbearing base said panel being curved and extending beyond the frontsides of the uprights, and said cross-beam being curved and extending beyond the frontsides of the uprights such that a frontmost surface of the panel is substantially flush with an outermost surface of the cross-beam.

7. The system of claim 6, wherein the piece of furniture is mounted to the wall.

8. The system of claim 6 further comprising plates connected between the uprights for mounting a television to the piece of furniture.

9. The system of claim 6, wherein when the backsides of the uprights are placed flush against the wall, the piece of furniture appears to be part of and integral with the wall.

10. The piece of furniture of claim 1 wherein the cross-beam extends beyond the frontsides of the uprights an amount less than the shelf extends beyond the frontsides of the uprights.

11. The piece of furniture of claim 10 wherein the loadbearing base extends beyond the frontsides of the uprights substantially the same amount as the cross-beam.

12. The piece of furniture of claim 1 wherein the panel is in contact with the cross- beam.

13. The piece of furniture of claim 1 further comprising:

a second cross-beam interconnecting the uprights;

a second shelf for holding electronic devices, the second shelf being removably connected to the second cross-beam and extending beyond the frontsides of the uprights;

a second panel for concealing wires of electronic devices, the second panel being removably connected to the uprights in such a way that a second internal space is created between the second panel and the plane defined by the backsides of the uprights, the second panel is located between the shelf and the second shelf, and the second internal space does not include substantially all of a top of either the shelf or the second shelf.

14. The piece of furniture of claim 13 wherein the second panel is in contact with the top of one of the shelf or the second shelf.

15. The piece of furniture of claim 13 wherein the second panel is not in contact with the top of either the shelf or the second shelf.

* * * * *